US005257896A

United States Patent [19]

Hastings

[11] Patent Number: 5,257,896

[45] Date of Patent: Nov. 2, 1993

[54] FLATBED LOADING CONFINEMENT SYSTEM

[76] Inventor: Thomas M. Hastings, 9708 Valaretta Dr., Gretna, Nebr. 68028

[21] Appl. No.: 870,921

[22] Filed: Apr. 20, 1992

[51] Int. Cl.[5] ..... B65D 19/00

[52] U.S. Cl. ..... 414/608; 108/53.1; 108/55.1; 108/56.1

[58] Field of Search ..... 914/607, 608; 108/51.1, 108/52.1, 53.1, 53.5, 55.1, 56.1, 56.3

[56] References Cited

U.S. PATENT DOCUMENTS

| | | | |
|---|---|---|---|
| 3,568,608 | 3/1971 | Taylor | 108/53.1 |
| 3,840,135 | 10/1974 | Bridge | 414/608 |

FOREIGN PATENT DOCUMENTS

| | | | |
|---|---|---|---|
| 2030480 | 1/1972 | Fed. Rep. of Germany | 108/55.1 |
| 357179 | 6/1973 | Sweden | 108/56.1 |
| 467870 | 5/1975 | U.S.S.R. | 108/55.1 |

*Primary Examiner*—Frank E. Werner
*Attorney, Agent, or Firm*—George R. Nimmer

[57] ABSTRACT

Augmented for the prior art environment of a cargo-loadable horizontal rectangular flatbed rectangularly areally defined by a pair of longitudinal-edges and a pair of shorter transverse-edges, an upwardly erectable confinement system for loads and which at said upwardly erected confinement-condition is structurally attainable by: pivotably attached to the flatbed two transverse-edges, rectangular and pivotably erectable endgates which respectively also include pivotable longitudinally lengthy parallel arms; along each flatbed longitudinal-edge, a pair of pivotably uprightable posts respectively including a tines-receiveable opening therethrough; removable attachments between each uprightable post and its neighboring loftily-erected longitudinally-lengthy arm; and possibly also, bracing means between adjacently parallel longitudinally-lengthy arms and braceable struts for each pivotably uprighted post. At upwardly erected confinement-condition, there is the confineability for flatbed loads having a cubic-volume mathematically defined by the multiplication of: substantially the entire area of the horizontal flatbed, and the lofty-height of the pivotably uprighted posts, and the arms and bracing means at said same lofty-height. A loaded flatbed at said confinement-condition can be moved by a forklift upon a similarly loaded flatbed at confinement-condition.

5 Claims, 2 Drawing Sheets

10F
40AD
42
46
45
FD
22D
21D
20D
23D
29
30AD
50AD
41
51
F
FS
FL
FT
FB
FA
50BD
30BD
40BD
50AC
30AC
40AC
50BC
30BC
40BC
20C
21C
22C
23C
FC
2
44
43
49(46,56)
34
LH
56
57
47

FLATBED LOADING CONFINEMENT SYSTEM

RELATED DISCLOSURE DOCUMENT

Please make "of record" applicant-Hastings' Disclosure Document number 298,445 (dated Dec. 31, 1991, and filed Jan. 7, 1992) in the instant patent application.

BACKGROUND OF THE INVENTION

Drawing FIG. 5 ("prior art") is a top plan view of a prior art, topically cargo-loadable flatbed (vehicular or non-vehicular) having a horizontal planar cargo-loadable upper-surface (FS) extending directionally longitudinally along a central longitudinal-axis "FL" and extending directionally transversely along a central transverse-axis "FT". The said flatbed horizontal planar upper-surface FS is rectangularly areally defined by four upright lineal edges including longitudinal left-edge FA and right-edge FB parallely flanking longitudinal-axis FL, and further including transverse first-edge FC and second-edge FD parallely flanking transverse-axis FT.

Inasmuch as cargo-loads ladable upon flatbed upper-surface FS are desirably confined at the flatbed edges (FA, FB, FC, FD), a load-confinement along these four edges is necessary. In this regard, a such load-confinement system should not extend beyond the flatbed peripheral rectangular area (defined by FA, FB, FC, FD), lest said cargo-loadable area (FA,FB,FC,FD), and having a confined lofty-height "LH" thereabove, is not infringed upon. Moreover, a said rectangularly areally confined cargo-loadable area should be topically confined at "LH" and thereby movably-liftable (with a forklift truck, or the like) upon another similarly loadable flatbed (F, 10F) indicated in phantom lines of FIGS. 2 and 4.

GENERAL OBJECTIVE OF THE PRESENT INVENTION

In view of the foregoing, it is the general objective of the present invention to provide a confinement system for a cargo-loaded flatbed upper-surface and which confinement system is upwardly erectable from a downwardly-collapsed normal-condition to a said upwardly erected confinement-condition that defines a near-optimal cargo-loadable cubic-volume that is mathematically the multiplication-product of:

substantially the entire said flatbed upper-surface rectangular area, as multiplied by a regular finite lofty-height LH thereabove. Thus, at said upwardly erected confinement-condition, cargo-loads can extend throughout the areal extent of the flatbed upper-surface FS and thereabove for a regularly constant lofty-height LH. Moreover, at said erected confinement-condition, there is loftily provided the capability for forklift tines to project therethrough and lift said confinement-condition cargo-load (i.e. at 10F) to be topically loaded upon a similarly employed flatbed(10F).

General Statement of the Invention

With the above general objective in view, and together with other ancillary and related specific objectives which will become more apparent as this description proceeds, the flatbed loading confinement system of the present invention generally comprises: extending along and pivotably attached to the two directionally transversely extending edges of the flatbed, rectangular endgates respectively having a free upper-end which is pivotably provided with a pair of arms that flank the flatbed central longutudinal-axis; extending normally along and pivotably attached to each of the two flatbed lengthwise edges, a pair of pivotably uprightable posts that flank the flatbed central transverse-axis, topical-end portions of each pivotably uprightable post being provided with a tines-receiveable opening therethrough; removable attachment means between each of said four longitudinal arms with an immediately neighboring pivotably uprighted post; and also several other permissible structural features augmenting attainment of the invention objectives including (but not limited to): controllably longitudinally directionally shiftable endgates; utilizing flexibly-universal joints for attaching the pivotably uprightable posts (at downwardly collapsed normal-condition) within recesses of the flatbed longitudinal edges; etc.

Brief Description of the Drawing

In the drawing, wherein like characters refer to like parts in the several views, and in which.

Detailed Description of the Drawing

Figure 5:
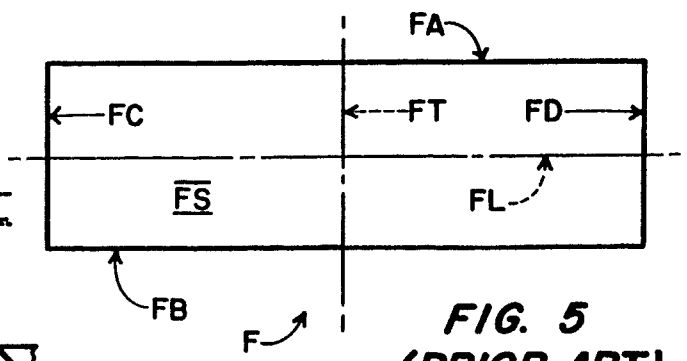
FIG. 5 (PRIOR ART)
FIG. 5 ("prior art") is a top plan view of a topically loadable flatbed environment (F) for the loading confinement system (e.g. 10F) of the present invention, said loadable flatbed environment (F) having a rectangularly-defined horizontal cargo-loadable upper-surface horizontal plane (FS)

Drawing FIG. 5 alludes to a prior art flatbed environment (F) having a horizontal cargo-loadable upper-surface horizontal plane (FS) extending directionally longitudinally along a central longitudinal-axis "FL" and extending directionally transversely along a central transverse-axis "FT". The said horizontal planar upper-surface (FS) is rectangularly areally defined by four upright lineal edges including left-edge "FA" and right-edge "FB" parallely flanking longitudinal-axis "FL", and further including first-edge "FC" and second-edge "FD" parallely flanking transverse-axis "FT".

As depicted in drawing FIGS. 1–4, representative embodiment (10F) of the present invention incorporates a said flatbed environment (10F) and thence structurally augmented (e.g. at 20, 30, 40) to provide a said flatbed loading confinement system (e.g. 10F). And specifically, the invention (e.g. 10F) has a downwardly collapsed normal-condition lying alongside flatbed upper-surface FS and an upwardly erected confinement-condition located above said flatbed horizontal upper-surface FS.

The Invention at "Normal-Condition"

Figures 1, 2:
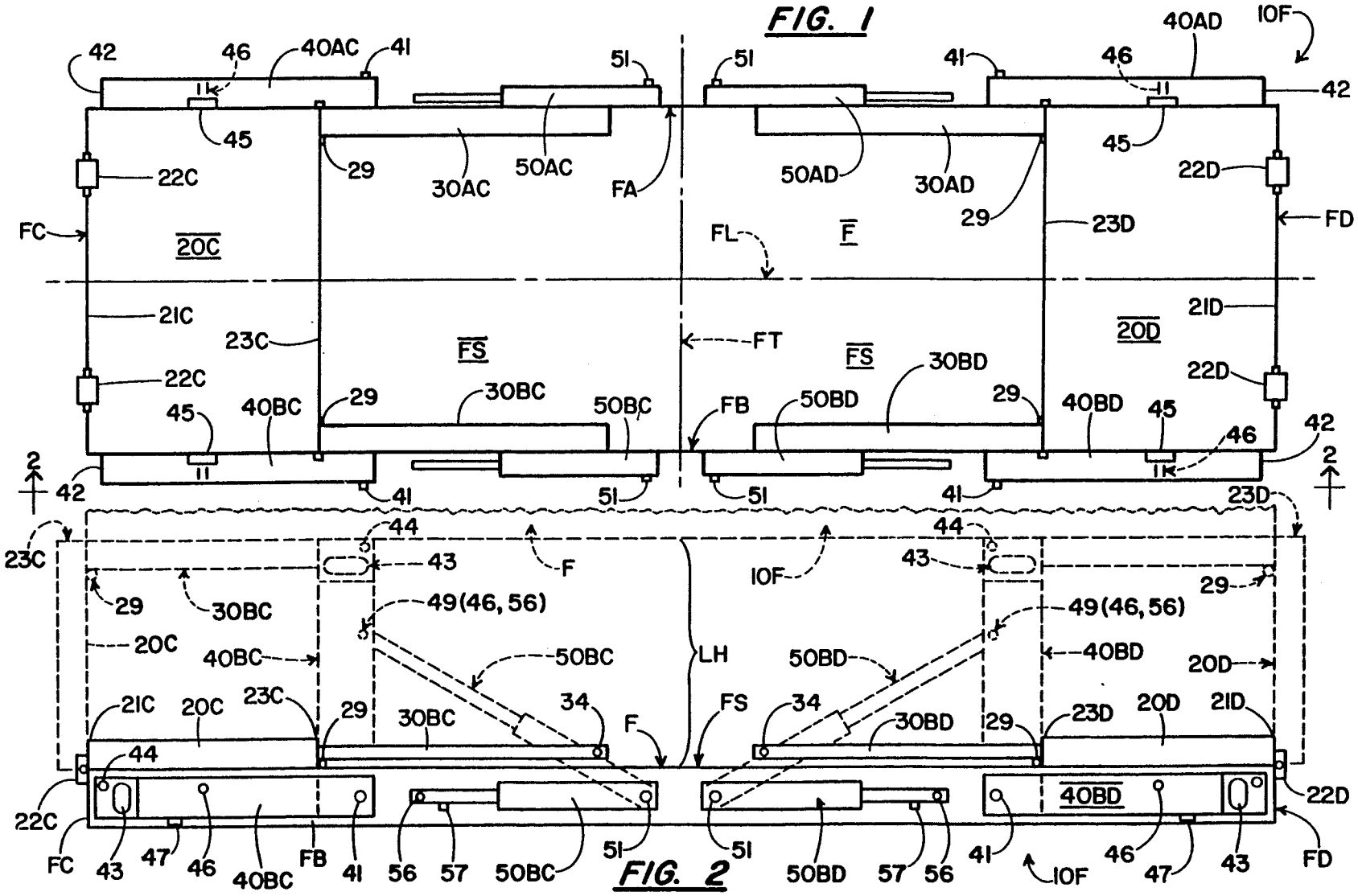
FIG. 1 is a top plan view of a representative embodiment (e.g. 10F) of the flatbed loading confinement system of the present invention in the invention downwardly-collapsed normal-condition.
FIG. 2 is a sectional elevational view taken along line 2—2 of FIG. 1, and with solid lines showing the invention embodiment (e.g. 10F) in the downwardly-collapsed normal-condition and with phantom lines indicating the invention embodiment (e.g. 10F) in the upwardly erected confinement-condition.

As alluded to in drawing FIG. 1 and in drawing FIG. 2 (solid lines), the flatbed confinement system in downwardly collapsed normal-condition comprises the following structural elements described in the following paragraphs (N-1), (N-2), and (N-3), namely:

(N-1) a pair of broadly rectangular endgates lying upon flatbed upper-surface FS and including: a first-endgate 20C having a lower-end 21C extending along and pivotably attached (22C) to said flatbed first-edge FC and having a transversely extending upper-end 23C located between first-edge FC and transverse-axis FT; and analagously also, a second-endgate 20D having a lower-end 21D extending along and pivotably attached (22D) to flatbed transverse second-edge FD and having a transversely extending upper-end 23D located between second-edge FD and flatbed transverse-axis FT;

(N-2) extending horizontally along flatbed longitudinal left-edge FA and flanking transverse-axis FT is a first-left-post 40AC pivotably attached (41) to left-edge FA and also a second-left-post 40AD pivotably attached(41) to left-edge FA. Analagously extending along flatbed right-edge FB and flanking axis FT is a first-right-post 40BC pivotably attached (41) to right-edge FB and also a second-right-post 40BD pivotably attached (41) to right-edge FB. Each of said four posts 40, remote from its pivotal connection 41, has a topical-end 42, thereat preferably provided with a pair of transversely extending openings therethrough including: a larger tine-receiving opening 43 and a smaller aperture 44; and (N-3) the respective endgates (20C, 20D) at respective upper-ends (23C, 23D) are each pivotably provided (29) with paired horizontal longitudinal arms (30A-C-30BC, 30AD-30BD), each pair flanking longitudinal-axis FL and restable upon flatbed upper-surface FS. Preferably, there are horizontal X-shaped braces 35C and 35D attached between each adjacent pair of arms. (However, such optional braces are eliminated from FIG. 1). Remote of each pivot 29, each arm 30 might be provided with a transversely extending aperture 34.

The Invention at "Confinement-Condition"

Figure 3:
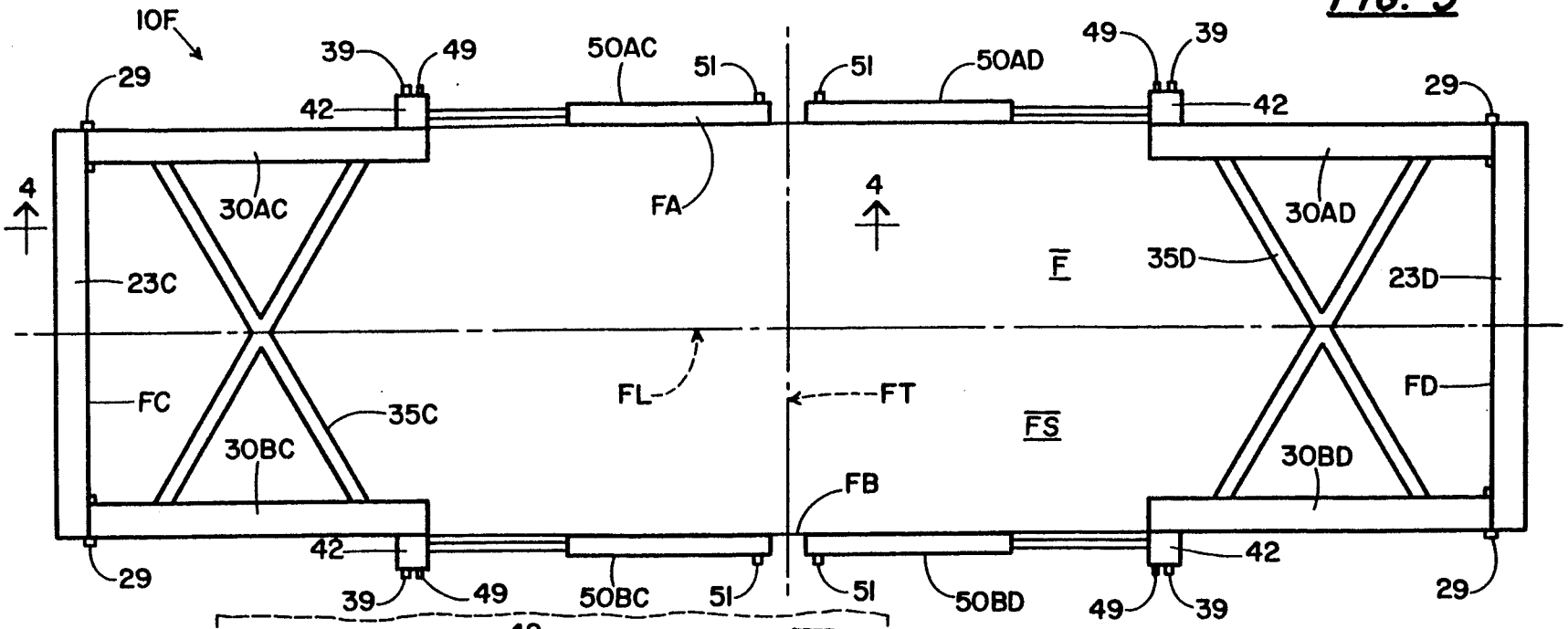
FIG. 3 is a top plan view of invention representative embodiment 10F in the upwardly erected confinement-condition, and which drawing Figure is bi-directionally symmetrical with respect to reference-line "FL" and also with respect to reference-line "FT"
Figure 4:
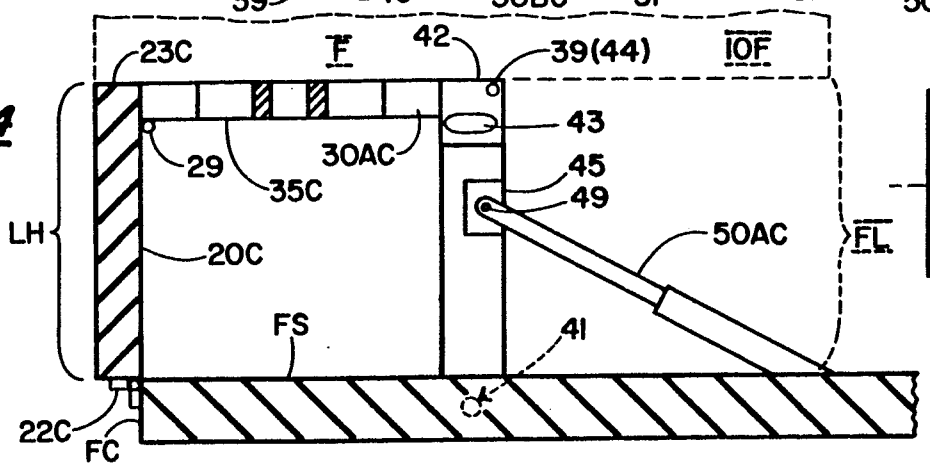
FIG. 4 is a sectional elevational view taken along line 4—4 of FIG. 3.

As alluded to in drawing FIGS. 3 and 4, and in the phantom lines condition for FIG. 2, the flatbed confinement system (e.g. 10F), in upwardly erected confinement-condition, loftily employs the elements (e.g. 20, 30, 40) described in preceeding paragraphs (N-1)-(N-3), as described in the following paragraphs (C-1), (C-2), and (C-3), namely:

(C-1) first-endgate 20C extends pivotably (22C) upwardly from flatbed first-edge FC whereby first-endgate upper-end 23C is located a finite lofty-height "FH" above flatbed upper-surface FS. Analagously, second-endgate 20D extends pivotably (22D) upwardly from flatbed second-edge FD whereby second-endgate upper-end 23D is located substantially said given finite-height FH above upper-surface FS;

(C-2) each of said four posts 40 extend pivotably (41) upwardly from the flatbed longitudinal-edges, whereby the topical-end 42 of each post is located substantially said same lofty-height LH above flatbed upper-surface FS; and (C-3) the free-end of each longitudinal arm 30 (i.e. remote of its pivotal connection 29) is attached adjacent the topical-end 42 of its neighboring uprighted post 40. Thus, each longitudinal arm 40 and their braces 35 are all located substantially said same lofty-height LH above flatbed upper-surface FS. One type of arm-to-post attachment might be in the form of four pins 39, respective pins extending through a set of transversely aligned apertures 34 and 44 (of an arm 30 and of a post 40).

Accordingly, the loadable "confinement-condition" described in paragraphs (C-1)-(C-3) hereabove defines a cargo-loadable cubic-volume that substantially attains the mathematic product of the entire said flatbed upper-surface rectangular area, as multiplied by, a regular finite lofty-height LH above upper-surface FS. Moreover, by virtue of said regular lofty-height LH, and the presence immediately therebelow of tines-receiveable openings 43, a cargo-loaded structure (e.g. 10F) can be moved by a forklift truck, or the like, to assume a stackable relationship upon another like structure (10F), as indicated by phantom line conditions for flatbed "F" in drawing FIGS. 2 and 4.

A desirable optional feature includes lengthy (and preferably telescopably extendable) struts 50 pivotably (51) attached to the flatbed longitudinal edges (FA, FB) and which:

(i) at normal-condition, the struts 50AC and 50AD lie alongside flatbed longitudinal-edge FA and in flanking relationship to flatbed transverse-axis FT, and the struts 50BC and 50BD lie horizontally alongside flatbed longitudinal-edge FB and in flanking relationship to said transverse-axis FT; and (ii) at confinement-condition, the struts 50 (remote of pivots 51) are inclined and are removably attached (49) to an intermediate height of respective uprighted post 40. In the latter regard, each post might be routed (45) and transversely apertured (46) thereat, so that an attachment pin (49) might be removably inserted through a set of transversely aligned apertures 46 and 56.

"47" and "57" indicate underlying supports for the respective uprightable posts 40 and the respective struts 50 at their horizontal normal-conditions.

From the foregoing, the construction and operation of the flatbed confinement system will be readily understood and further explanation is believed to be unnecessary. However, since numerous modifications and changes will readily occur to those skilled in the art, it is not desired to limit the invention to the exact construction shown and described, and accordingly, all suitable modifications and changes and equivalents may be resorted to, falling within the scope of the appended claims.

I claim:

1. For a cargo-loadable flatbed environment having a horizontal cargo-loadable upper-surface horizontal plane extending directionally longitudinally along a central longitudinal-axis and extending directionally transversely along a central transverse-axis, and which upper-surface is rectangularly areally defined by four upright lineal edges including left-edge and right-edge flanking said longitudinal-axis and first-edge and second-edge flanking said transverse-axis, a load confinement system that in a flatbed non-loaded normal-condition lies generally along said flatbed upper-surface horizontal plane and that is stably pivotably uprightably erectable to a flatbed loadable confinement-condition which defines a cubic-volume substantially equal to a mathematical product of said flatbed upper-surface area and a regular finite lofty-height thereabove, said flatbed loading confinement system comprising:

(A) in its normal-condition comprising: a pair of horizontal and pivotably uprightable endgates including a first-endgate having a lower-end extending along and pivotably attached to said flatbed first-edge and having a transversely extending upper-end located between said first-edge and said transverse-axis, and analagously including a second-endgate having a lower-end extending along and pivotably attached to said flatbed second-edge and having a transversely extending upper-end located between said second-edge and said transverse-axis, and each said endgate at the upper-end thereof being pivotably provided with a pair of horizontal longitudinal arms flanking said flatbed longitudinal-axis;

(B) in its normal-condition also comprising: extending horizontally along and pivotably attached to said flatbed left-edge, a first-left-post and a second-left-post flanking said transverse-axis, and extending horizontally along and pivotably attached to said flatbed right-edge, a first-right-post and a second-right-post flanking said transverse-axis, and each of said pivotal posts having a topical-end located remote of its pivotal attachment to the flatbed; and (C) in its confinement-condition comprises: said first-endgate and second-endgate being pivotably uprighted from the flatbed first-edge and second-edge, respectively; the first-left-post and the second-left-post being pivotably uprighted from the flatbed left-edge; the first-right-post and the second-right-post being pivotably uprighted from the flatbed right-edge; the said four posts at their topical-ends having attachment means and being removably attached to neighboring longitudinal arms; and the said four posts topical-ends and the said four removably attached longitudinal arms being all substantially located at a finite lofty-height above the flatbed horizontal upper-surface; whereby another similar flatbed at a confinement-condition can be stackably supported thereupon at said finite lofty-height.

2. The flatbed confinement system of claim 1 wherein each of the four pivotably uprightable posts, immediately/below a topical-end thereof, is provided with a transversely extending opening therethrough, to accommodate a forklift time therethrough, whereby a forklift can attain a stackable relationship among similar flatbeds having said confinement-conditions.

3. The flatbed confinement system of claim 2 wherein the pivotal horizontal longitudinal arms of the first-endgate are tied together with horizontally transversely extending first-braces, and the pivotal horizontal longitudinal arms of the second-endgate are tied together with horizontally transversely extending second-braces, and whereby said first-braces and second-braces at said confinement-condition are at a finite lofty-height overlying relationship.

4. The flatbed confinement system of claim 1 wherein the pivotal horizontal arms of the first-endgate are tied together with horizontally transversely extending first-braces, and the pivotal horizontal longitudinal arms of the second-endgate are tied together with horizontally transversely extending second-braces, whereby said first-braces and second-braces at said confinement-condition are at a finite lofty-height overlying relationship.

5. The flatbed confinement system of claim 1 wherein in its normal-condition also comprises: extending horizontally along and pivotably attached to the flatbed left-edge, a first-left-strut and a second-left-strut flanking said transverse-axis; extending horizontally along and pivotably attached to the flatbed right-edge, a first-right-strut and a second-right-strut flanking said transverse-axis; and each of said pivotal struts being provided with a head-end located remote of its pivotal attachment to the loadable flatbed; and wherein in its confinement-condition the head-end of respective struts are removably attached to an immediately adjacent, pivotably uprighted post.

* * * * *